United States Patent [19]

Kolka

[11] 4,180,261

[45] Dec. 25, 1979

[54] EXERCISING DEVICE FOR RUNNERS

[76] Inventor: Leigh E. Kolka, R.R. #2, Box 145A, Fox Rr. Dr., Plano, Ill. 60545

[21] Appl. No.: 918,590

[22] Filed: Jun. 23, 1978

[51] Int. Cl.[2] ..... A63B 23/04

[52] U.S. Cl. ..... 272/119; 2/22

[58] Field of Search ..... 272/119, 117, 96, 93; 2/22, 24; 128/80 G

[56] References Cited

U.S. PATENT DOCUMENTS

| | | | |
|---|---|---|---|
| 1,269,829 | 6/1918 | Lumley | 2/24 |
| 1,583,181 | 5/1926 | Rubio | 2/24 |
| 1,772,923 | 8/1930 | Volz | 2/22 |
| 2,241,833 | 5/1941 | Waller | 272/119 |
| 2,952,459 | 9/1960 | Moffitt | 272/119 |
| 3,366,380 | 1/1968 | Montour | 272/119 |
| 3,427,020 | 2/1969 | Montour | 272/119 |
| 3,528,652 | 9/1970 | Tarbox | 272/119 |
| 3,628,536 | 12/1971 | Glesne | 128/327 |
| 3,751,031 | 8/1973 | Yamauchi | 272/119 |
| 3,759,510 | 9/1973 | Jackson | 272/96 |

FOREIGN PATENT DOCUMENTS

| | | | |
|---|---|---|---|
| 930754 | 7/1973 | Canada | 272/119 |

*Primary Examiner*—Richard J. Johnson

*Attorney, Agent, or Firm*—B. P. Fishburne, Jr.

[57] ABSTRACT

To acquire greater speed in running, variable weights are attached to the fronts of the thighs slightly above the knees. The weights and their pocketing structure are suspended from a waist belt by adjustable hip suspension straps. Greater effort is required in picking up the legs while running and muscles important to running are strengthened.

5 Claims, 6 Drawing Figures

FIG. 2
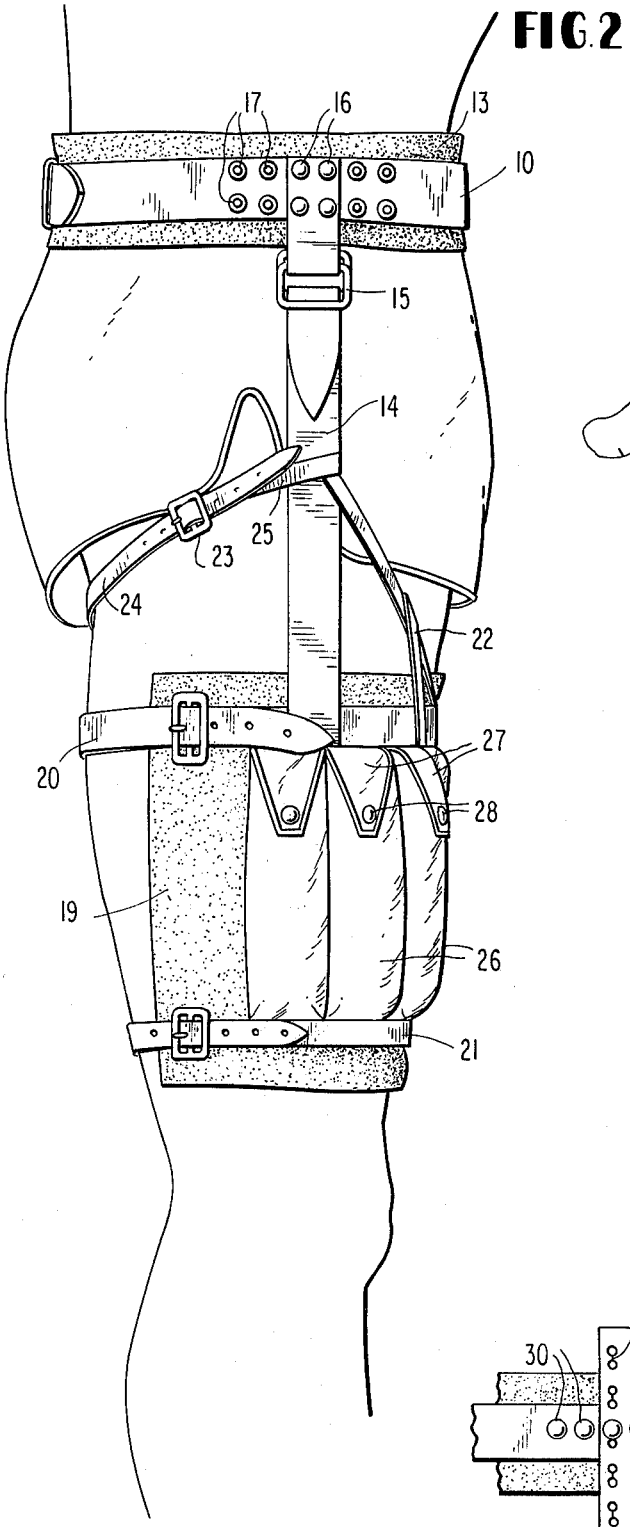
FIG. 1
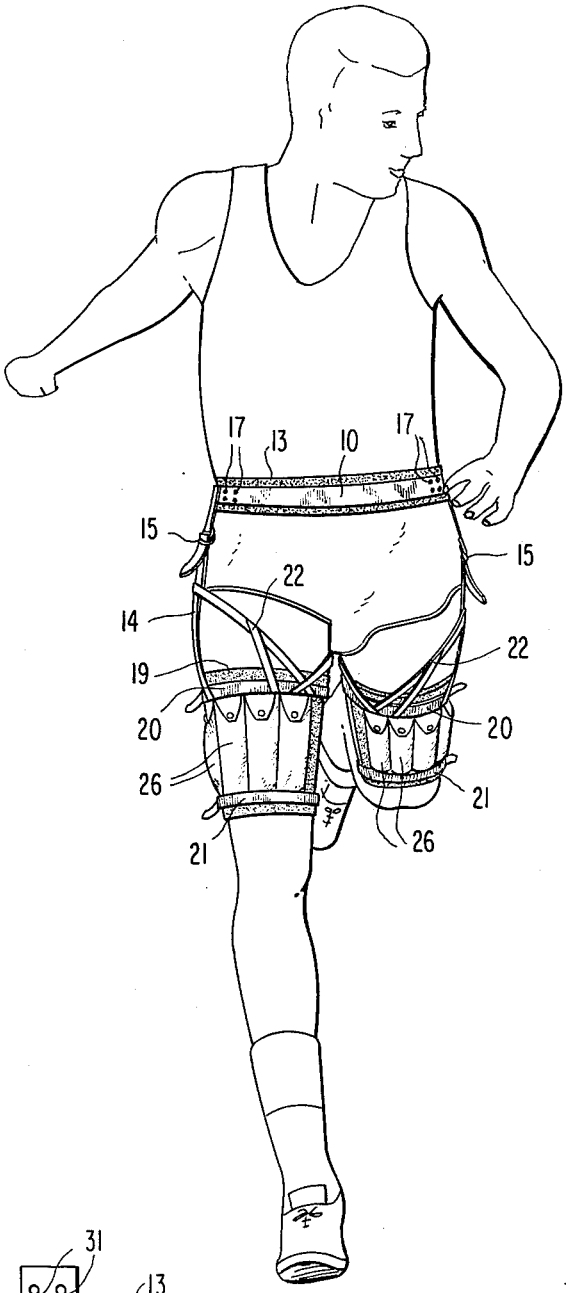
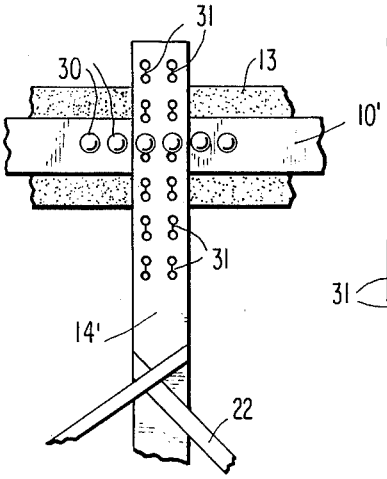
FIG. 5
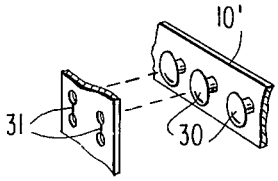
FIG. 6

EXERCISING DEVICE FOR RUNNERS

BACKGROUND OF THE INVENTION

The current popularity of running by people of all ages has created a demand for equipment to increase running speed. In order to accomplish this objective, any exercising equipment employed by the runner must be effective to strengthen the muscles which are most vital to running. In particular, these are the muscles which are employed to pick up the thighs during the motion of running and the objective of the invention is realized by placing weights on the fronts of the thighs of a runner slightly above the knees and securing the weights in a firm but comfortable manner in accordance with the invention.

Numerous leg exercising devices are known in the prior art but no known device is designed to exercise the leg muscles which control the lifting of the thighs while running.

To comply with the duty of disclosing known prior art under 37 C.F.R. 1.56, the following United States patents are made of record herein: U.S. Pat. Nos. 2,241,833; 3,427,020; 2,952,459; 3,528,652; and 3,759,510.

SUMMARY OF THE INVENTION

Exercising weights are contained in pockets carried by comfort pads which surround the fronts of a runner's thighs. Upper and lower thigh encircling adjustable belts are provided for each leg. Additional weights can be permanently attached to the comfort pads. An adjustable support belt surrounds the waist of the runner and a pair of side adjustable suspension straps have their lower ends anchored to the two thigh weighting assemblies of the exercising device. Adjustable reinforcing and stabilizing straps are also provided on each thigh weighting assembly. The two side suspension straps of the device are also adjustable lengthwise of the waist belt to properly locate the suspension straps on the hips of the runner for maximum efficiency and comfort.

BRIEF DESCRIPTION OF THE DRAWINGS

FIG. 1 is a front perspective view of an exercising device for runners according to the invention.

FIG. 2 is an enlarged side elevation of the invention as worn by a runner.

FIG. 5 is a fragmentary side elevation showing a modification of side suspension strap adjusting means.

FIG. 6 is a fragmentary exploded perspective view of the adjusting means in FIG. 5.

DETAILED DESCRIPTION

Figures 3, 4:
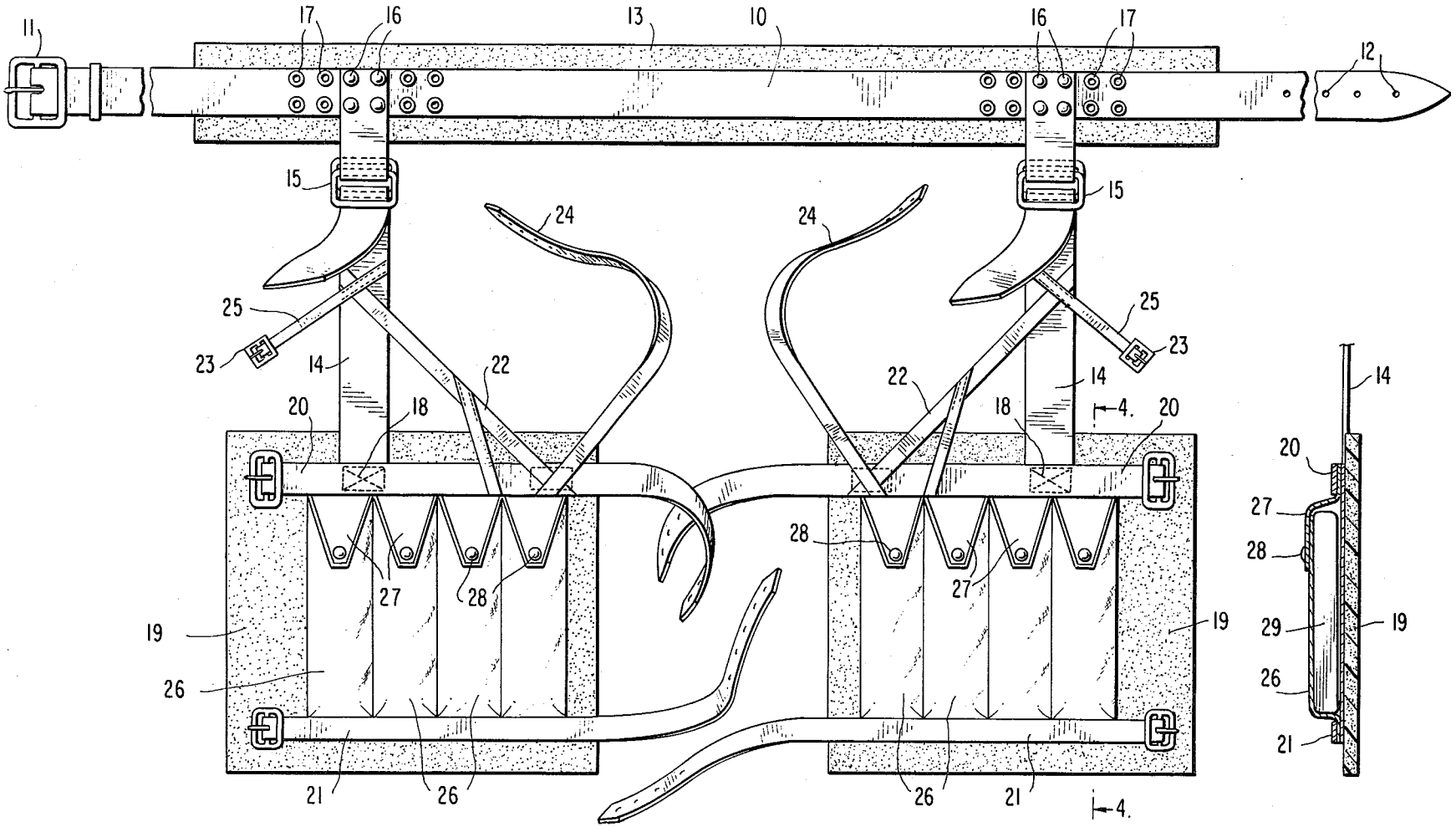
FIG. 3 is a plan view of the exercising device in a laid-out flat condition.
FIG. 4 is a fragmentary vertical section taken on line 4—4 of FIG. 3.

Referring to the drawings in detail, wherein like numerals designate like parts, the numeral 10 designates an adjustable waist or support belt for the exercising device having a conventional buckle 11 at one end thereof and adjusting apertures 12 near its opposite end. As shown in FIGS. 1 and 2, the buckle is disposed at the back of the runner, although, if preferred, the adjusting buckle can be arranged at the front of the support belt 10. A preferably rubber pad 13 is suitably attached to the interior of the support belt 10 for the sake of comfort.

A pair of side vertically extending adjustable suspension straps 14 are provided and each of these straps includes a length-adjusting buckle means 15 connected therein, as shown. The tops of the suspension straps 14 are connected to the support belt 10 by snap fasteners 16, and to render the two straps 14 adjustable at the hip regions on the belt 10, two rows of snap fastener elements 17 are provided on the support belt in the regions of the hips so that the proper adjustments of the straps 14 can be made with convenience. Thus, the two vertical suspension straps 14 on opposite sides of the device are adjustable lengthwise or vertically as well as fore and aft by means of the snap fasteners.

Secured as at 18 to the bottoms of the suspension straps 14 are rectangular flexible thigh comfort pads 19 of foam rubber, thick felt or the like. During use, the pads 19 cover the fronts of the thighs immediately above the knees of the runner. An upper adjustable thigh belt 20 is carried by each pad 19 near the top thereof and at the bottom of the adjacent suspension strap 14 to which the belt 20 may be attached at 18. A lower adjustable thigh belt 21 is also provided near the bottom of each pad 19 and may be secured to the pad or formed separately therefrom, if preferred. In the use of the device, the two belts 20 and 21 encircle the thighs of the runner, as shown in FIGS. 1 and 2, with the rectangular pads 19 covering the fronts of the thighs, as illustrated.

An additional suspending and stabilizing strap network 22 having an adjusting buckle 23 is attached to the upper thigh belts 20 and vertical suspension straps 14, as shown in the drawings. The strap elements 24 and 25 of these stabilizing arrangements may encircle the tops of the legs of the runner as best shown in FIG. 2.

Firmly attached to the front sides of the pads 19 between the belts 20 and 21 is a plurality, preferably four, of vertically extending top opening independent pockets 26 each having a top closure flap 27 secured by a snap fastener 28. Removably secured within each vertical pocket 26 is a suitable weight 29, FIG. 4, or a plurality of weight sections, if preferred. For example, each pocket 26 may contain a 1.25 or 1.50 pounds weight. The mass of the weights may vary to suit the needs of individuals. Also, in some cases, weights can be permanently attached to the fronts of the pads 29 together with or in lieu of the pocketed weights. The pocketed arrangement is very convenient because it allows ready varying of the total weight used in the exercising device. As the legs become stronger, the amount of weight may be increased. As a variation of the invention, FIGS. 5 and 6, in lieu of the snap fasteners 16 and 17 and the adjusting buckle 15, the support belt 10' may be equipped at the hip regions with a row of headed fasteners 30 engageable selectively within buttonhole-like slits 31 formed in two vertical rows in the side suspension straps 14'. With this arrangement, the suspension straps 14' can be adjusted simultaneously laterally and vertically relative to the waist belt.

The exercising device, while simple, is very secure on the runner and comfortable so as not to interfere with running. It is fully adjustable at the waist, around the thighs, and vertically through the straps 14 or 14' to fit all sizes of individuals. Its many advantages over the prior art should now be apparent.

It is to be understood that the form of the invention herewith shown and described may be taken as a preferred example of the same, and that various changes in the shape, size and arrangement of parts may be resorted to, without departing from the spirit of the invention or scope of the subjoined claims.

I claim:

1. An exercising device for runners comprising a support belt adapted to encircle the waist of a runner, a pair of side substantially vertical adjustable length suspension straps dependingly secured to opposite sides of the support belt adjacent to the hips, and thigh weight assemblies secured supportingly to said side suspension straps and being flexible circumferentially of the thighs and adapted to extend about the fronts of the thighs, and thigh girth adjusting means on said thigh weight assemblies whereby the assemblies can be made to adhere snugly to the thighs during running while receiving primary support through said side suspension straps from said support belt.

2. An exercising device for runners as defined in claim 1, and relatively wide soft flexible pads carried by the interior sides of said support belt and thigh weight assemblies to promote the comfort of runners wearing the exercising device.

3. An exercising device for runners as defined in claim 2, and each thigh weight assembly including plural side-by-side substantially vertical weight receptor pockets which are articulated one relative to another on substantially vertical articulation axes.

4. An exercising device for runners as defined in claim 1, and each thigh weight assembly including plural substantially vertical side-by-side weight receptor pockets extending for the major portion of the height of said assembly at the frontal regions of the thighs.

5. An exercising device for runners as defined in claim 1, and means adjustably connecting the tops of the side suspension straps to the support belt, whereby the side suspension straps may be adjusted somewhat forwardly and rearwardly in the regions of the hips of a runner.

* * * * *